US006725486B2

(12) United States Patent
Oka

(10) Patent No.: US 6,725,486 B2
(45) Date of Patent: Apr. 27, 2004

(54) PIPE FITTING TOOL

(75) Inventor: Thomas J. Oka, Cincinnati, OH (US)

(73) Assignee: Oka Tool Company, Cincinnati, OH (US)

( * ) Notice: Subject to any disclaimer, the term of this patent is extended or adjusted under 35 U.S.C. 154(b) by 0 days.

(21) Appl. No.: 10/079,239

(22) Filed: Feb. 20, 2002

(65) Prior Publication Data

US 2003/0154552 A1 Aug. 21, 2003

(51) Int. Cl.[7] ..... B25B 7/22

(52) U.S. Cl. ..... 7/127; 7/125; 7/139; 7/165; 7/166; 81/429; 81/437

(58) Field of Search ..... 7/125, 127, 139, 7/165, 166, 129, 132; 81/429, 437, 438, 177.1, 177.4, 489, 490

(56) References Cited

U.S. PATENT DOCUMENTS

| | | | | | |
|---|---|---|---|---|---|
| 1,024,120 | A | * | 4/1912 | Crossley | 81/416 |
| 4,953,248 | A | * | 9/1990 | Trombetta | 7/107 |
| 5,014,379 | A | | 5/1991 | Hull et al. | 7/127 |
| 5,033,140 | A | | 7/1991 | Chen et al. | 7/127 |
| 5,134,908 | A | * | 8/1992 | Fisher | 81/414 |
| 5,150,488 | A | | 9/1992 | Yuan et al. | 37/137 |
| 5,259,281 | A | | 11/1993 | Burke | 81/437 |
| 5,280,659 | A | | 1/1994 | Park | 7/128 |
| 5,303,748 | A | | 4/1994 | Haldemann | 140/123 |
| 5,375,316 | A | | 12/1994 | Carlson et al. | 29/564.3 |
| 5,586,584 | A | | 12/1996 | Haldemann | 140/123.5 |
| 5,735,005 | A | | 4/1998 | Wang | 7/127 |
| 5,816,120 | A | | 10/1998 | Kilgore | 81/414 |
| 6,167,581 | B1 | | 1/2001 | Finn | 7/129 |
| 6,185,771 | B1 | | 2/2001 | Trusty, Sr. | 7/128 |
| 6,202,517 | B1 | * | 3/2001 | Dolan | 81/427 |
| 6,203,805 | B1 | * | 3/2001 | Collins et al. | 424/401 |
| 6,318,218 | B1 | * | 11/2001 | Anderson et al. | 81/440 |

* cited by examiner

*Primary Examiner*—Lee D. Wilson
*Assistant Examiner*—Alvin J. Grant
(74) *Attorney, Agent, or Firm*—Wood, Herron & Evans, LLP

(57) ABSTRACT

A pipe fitting tool is configured to aid a user in performing tasks frequently encountered by a pipe fitter or similar tradesman. The tool includes adjustable pliers, such as arc joint adjustable pliers, with a cutting portion for cutting and optionally stripping wire, and an impact surface for performing minor adjustments to hardware, such as adjusting the position of an object. One handle of the tool includes a prying/wedging portion and another handle of the tool includes a drive bit receiver. Molded hand grips may be provided on the handles and may include one or more receptacles for storing drive bits when not in use.

31 Claims, 2 Drawing Sheets

PIPE FITTING TOOL

FIELD OF THE INVENTION

This invention relates to hand tools and, in particular, to a combination hand tool suited for use in pipe fitting.

BACKGROUND OF THE INVENTION

In the mechanical and industrial trades, pipe fitters and similar tradesmen are often required to perform various tasks involved in the installation and fabrication of piping systems. Such activities may include the gripping of small and large diameter pipes, joints or fasteners; cutting and/or stripping wire; twisting wire to fashion temporary supports for hanging pipes; adjusting the location of pipe joints; adjusting the fit of welded joints; installing gaskets to flanged pipe joints; and the general loosening or tightening of fasteners. Individual tools specifically suited to performing the individual tasks recited above are known in the art and because pipe fitters perform such tasks on a frequent basis, many pipe fitters carry a variety of such tools with them on the job. These tools are often carried in a back pocket of the pipe fitter's clothing. Other times these tools are carried in a tool box/bucket or held in a utility belt worn by the pipe fitter. One drawback of using such a utility belt/back pocket and a variety of dedicated hand tools is that the belt and/or tools may become heavy or cumbersome for the wearer. In addition, the pipe fitter may be required to access various tools located in different carrying pouches on the utility belt, which may be inconvenient when the pipe fitter must use one hand to hold a work piece and reach across to a pouch located on a far-side of the belt to retrieve a tool. Tool boxes/buckets are also heavy and cumbersome, and thus not easily or conveniently moved from location to location during the installation of a large piping system, particularly where the pipe fitter is required to access the piping system via ladders.

Also known in the art are combination hand tools which combine two or more tools or functions into a single unit. While these combination tools are convenient and reduce the number of dedicated hand tools which must be carried by a user, the inventor is not aware of a combination tool that is specifically suited to aid pipe fitters in performing routine tasks, such as those described above. Specifically, while existing combination tools may include individual features or functions which are similar to those required by a pipe fitter, the available combination tools, as a whole, are not configured to provide features or functions in a manner particularly suited to a pipe fitter's needs. For example, a tool having a hammer suitable for driving nails might also have a prying feature suited to pulling nails. While this prying feature is adequate for pulling nails, the portion of the tool providing that feature is generally angled back toward a handle of the tool and therefore is not particularly useful in performing prying and wedging tasks faced by a pipe fitter, such as adjusting a welded pipe joint to obtain proper alignment, or separating a flange joint to install a gasket.

There is thus a need for a combination tool which is particularly suited to aid a pipe fitter in performing routine tasks and which may be conveniently carried by a pipe fitter on the job.

SUMMARY OF THE INVENTION

The present invention provides a combination tool which is particularly suited to facilitate the performance of various tasks frequently faced by a pipe fitter or similar tradesman. The hand tool includes adjustable pliers having a pair of adjustable grip jaws and elongated handle members. The tool further includes a pair of cutting edges, each positioned inward of the respective jaws. The cutting edges are useful for cutting wire and may be further provided with a notch formed into at least one of the cutting edges, to permit the stripping of insulated wire. The tool further includes an impact surface provided near the jaws of the pliers. The impact surface is reinforced for durability and striking efficiency.

A prying/wedging portion and a bit receiver are provided on the handle portions of the tool. The prying/wedging portion is useful for adjusting weld gaps and installing flange gaskets. Bits for the bit receiver may be stored in a pouch or receptacle provided on the tool's hand grips. There is thus provided a 5-in-1 combination tool that performs at least five functions regularly needed during the installation of piping systems. These and other objects and advantages of the present invention shall be made apparent from the accompanying drawings and detailed description.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Figure 1:
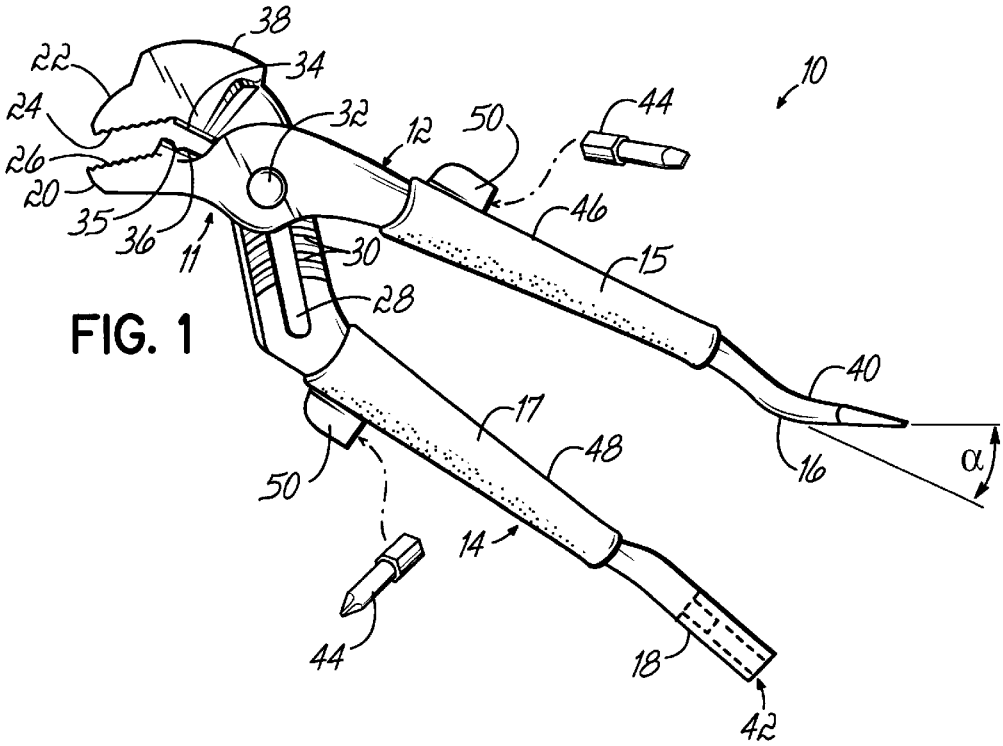
FIG. 1 is a plan view of an exemplary embodiment of a pipe fitting tool of the present invention.
Figure 1A:
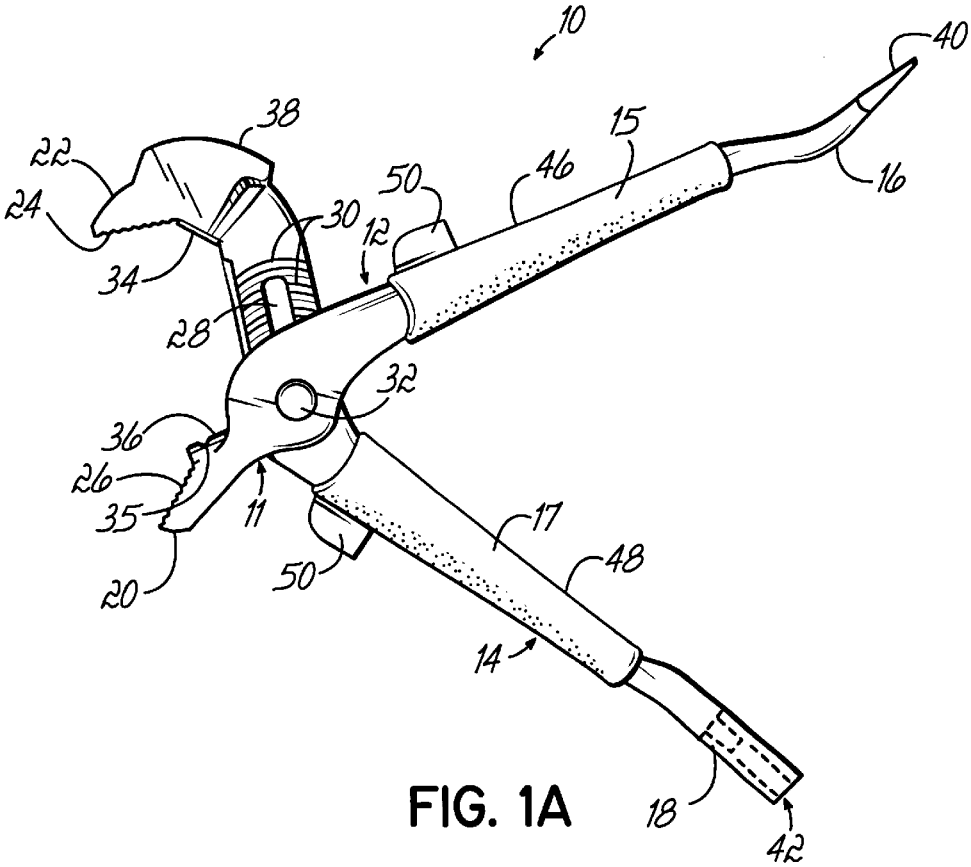
FIG. 1A is a plan view of the tool of FIG. 1, with the adjustable pliers in the fully opened position.

Referring to FIG. 1, there is shown an exemplary embodiment of a pipe fitter's tool 10 of the present invention. The tool 10 comprises arc joint adjustable pliers 11 comprising first and second elongated members 12, 14 pivotally attached to each other at attachment point 32 intermediate the ends of the elongated members 12, 14. As shown, attachment point 32 may be a riveted joint. Handle portions 15, 17 adjacent first ends 16, 18 of the elongated members 12, 14 allow the tool 10 to be gripped by the pipe fitter or other user. The second ends 20, 22 of the elongated members 12, 14 include the jaw portions 24, 26 of the pliers 11. The jaw portions are adapted to grip and manipulate various sized objects, such as pipes and bolts. The firs t and second elongated members 12, 14 are pivotally and slidably connected by interaction of attachment point 32 through a slot 28 on the second member 14. In the embodiment shown, the tool 10 includes a plurality of arcuate grooves 30 on the second member 14 surrounding the slot 28 and an arcately-shaped raised ridge (not shown) on the first member 12 near the attachment point 32, which ridge is configured to selectively intermesh with each of the grooves 30 so that the relative distance between the jaw portions 24, 26 may be adjusted between multiple positions, as further shown in FIG. 1A. Adjustable pliers include several known types which may be used in the tool 10 of the present invention, including adjustable joint, arc joint®, tongue and groove or slip joint pliers. Advantageously, the adjustable pliers 11 are arc joint adjustable pliers, as depicted in FIGS. 1 and 1A.

A pair of opposing cutting edges 34, 36 are located inward of the jaw portions 24, 26 of the pliers 11, toward the attachment point 32, with one cutting edge 34, 36 associated with each respective elongated member 12, 14. The cutting edges 34, 36 are configured such that when the jaw portions 24, 26 are clamped together, the cutting edges 34, 36 are brought into contact with one another whereby an object, in particular a wire, inserted between the cutting edges 34, 36 may be cut. The wire cutting function is needed, for example, to add or remove wire used to temporarily suspend pipes to facilitate their placement and installation into the piping system.

The second elongated member 14 has an impact surface 38 located on an exterior portion of the second member 14 adjacent end 22 and opposite the jaw 24 and cutting edge 34. In the exemplary embodiment shown, the impact surface 38 is provided by reinforcing a portion of the second member 14 with added material to provide striking efficiency and improved wear of the impact surface 38.

The exemplary pipe fitters' tool 10 shown in FIG. 1 further includes a wedge-shaped pry tool 40 located at the first end 16 of the first elongated member 12. The pry/wedge tool 40 is slightly angled away from the second elongated member 14 to provide leverage while permitting substantially head-on insertion of the pry/wedge tool 40 between surfaces to be pried or wedged apart. In an exemplary embodiment, the angle $\alpha$ between the tip of the pry/wedge tool 40 and the handle portion 15 of the first elongated member 12 is between about 10° and about 40°. While intended to perform a prying/wedging function, it may be appreciated that the wedge-shaped pry tool 40 could also function as a slotted screwdriver.

Figure 2:
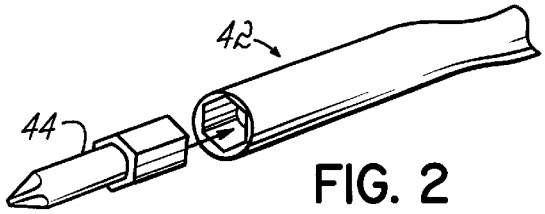
FIG. 2 is a perspective view showing detail of the bit driver portion of the tool of FIG. 1.

The second member 14 includes a bit receiver 42 formed into the first end 18 of the second member 14. In an exemplary embodiment, the bit receiver 42 is shaped to receive ¼-inch hex-shanked drive bits 44, as depicted in FIG. 2. The drive bits 44 may be retained within the bit receiver 42 by magnetic attraction or by a spring biased protrusion located within the bit 44 and designed to engage a detent when installed in the bit receiver 42. The pipe fitters' tool 10 may further include hand grips 46, 48 disposed on the handle portions 15, 17 of the first and second elongated members 12, 14. In the exemplary embodiment shown, the hand grips 46, 48 are formed from polymeric material to provide a cushioned and non-slip grip, and include receptacles 50 formed into the grips 46, 48 which serve to store drive bits 44 on the tool 10. Advantageously, two receptacles 50 are provided, one for storing a phillips-type drive bit 44 and one for storing a slotted-type drive bit 44. An allen wrench drive bit (not shown) could also be included and stored in a receptacle 50.

Figure 3:
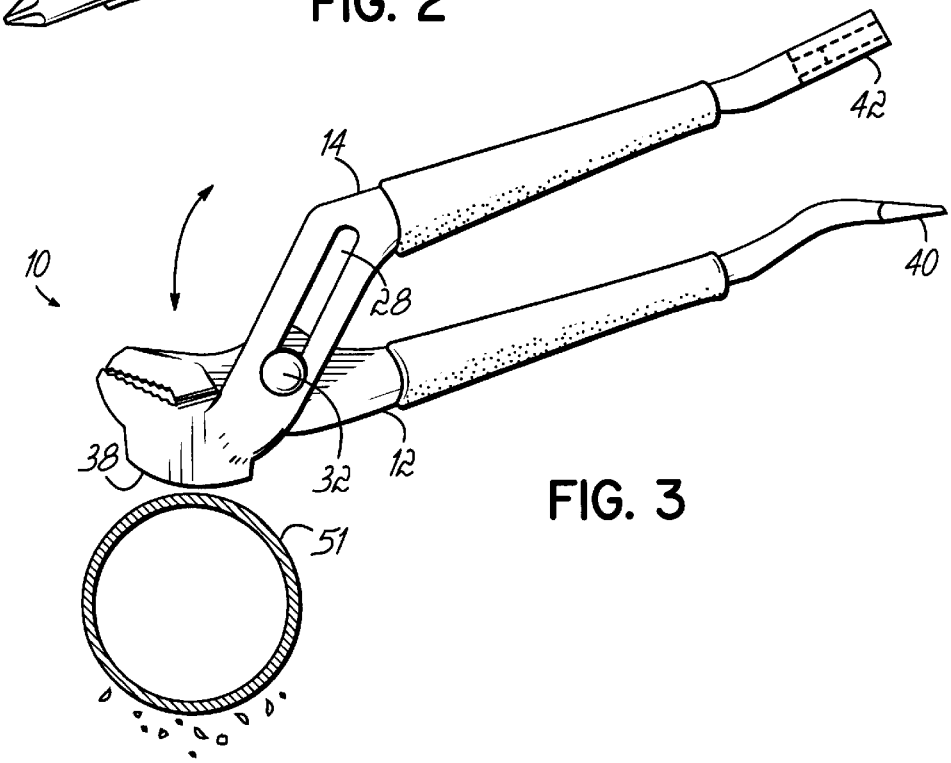
FIG. 3 is an illustration depicting the use of the impact surface of the tool of FIG. 1.
Figure 4:
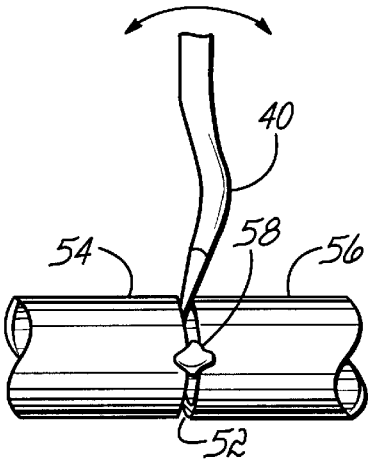
FIG. 4 is an illustration depicting the use of the pry/wedge tool portion of the tool of FIG. 1.
Figure 5:
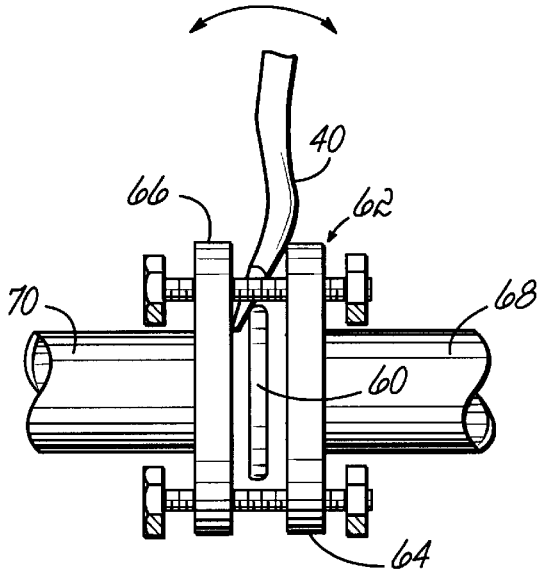
FIG. 5 is an illustration depicting another use of the pry/wedge tool portion.

FIGS. 3–5 depict the use of tool 10 to perform typical pipe-fitting tasks. FIG. 3 depicts the use of the impact surface 38 in facilitating the removal of metal chips 53 from pipe threads prior to installation of a screwed fitting (not shown). These metal chips 53 are generally present after the formation of the threads on the pipe 51 and can often be removed by light strikes to the pipe 51 with the impact surface 38 of the tool 10. The impact surface 38 is also useful for performing light impacts for the adjustment of pipe 51 or bracket location (not shown) during installation of a piping system (not shown).

FIGS. 4 and 5 depict the use of the wedge-shaped pry tool portion 40 of the tool 10. Referring to FIG. 4, the pry/wedge tool portion 40 may advantageously be inserted into the weld gap 52 between adjacent pipe ends 54, 56, which have been joined with a tack weld 58, to facilitate adjusting the weld gap 52 and relative axial alignment of the pipes 54, 56. The quality of the final weld requires uniformity of the weld gap 52 between the pipe ends 54, 56, whereby the pry/wedge tool portion 40 may be inserted at various locations around the circumference of the weld gap 52 and manipulated to provide fine adjustment as necessary.

FIG. 5 depicts the use of the wedge-shaped pry tool portion 40 to facilitate installation of a gasket 60 into a flanged joint 62 of a piping system. In typical piping systems, long lengths of pipe often result in a buildup of force tending to urge the pipes together, whereby it is physically difficult or cumbersome to separate the pipe and insert a gasket therebetween. Advantageously, the pry/wedge tool 40 may be inserted or wedged between the flanges 64, 66 and manipulated with one hand to separate the pipe ends 68, 70 and permit the gasket 60 to be inserted between them with the other hand. It may be appreciated that tool portion 40 is not intended as a pry bar for breaking apart two objects, but rather is intended for minor separations of two abutting objects.

While many combination tools have been developed, no single hand tool has previously been available that provides the multiple functions needed for pipe installation. The tool 10 of the present invention provides a single hand tool having adjustable pliers for gripping and manipulating various sizes of pipes and objects, a wire cutter and optionally a wire stripper, an impact or striking surface for facilitating movement of objects, a prying/wedging tool, and a drive bit receiver. These five functions are combined into one convenient tool to provide a pipe fitter with a tool that performs the majority of hand tool functions needed during installation of piping systems.

While the present invention has been illustrated by the description of an embodiment thereof, and while the embodiment has been described in considerable detail, it is not intended to restrict or in any way limit the scope of the appended claims to such detail. Additional advantages and modifications will readily appear to those skilled in the art. For example, the pliers portion of the combination tool may be adjustable between multiple positions by means other than arc joints, said means now known or hereafter developed. The invention in its broader aspects is therefore not limited to the specific details, representative apparatus and method and illustrative examples shown and described. Accordingly, departures may be made from such details without departing from the scope or spirit of Applicant's general inventive concept.

What is claimed is:

1. A pipe fitting tool comprising:

adjustable pliers having first and second handle portions pivotally attached at a joint to a pair of jaws adapted to grip objects therebetween, the joint further including a slot along which a pivot point is slidable to adjust a relative position of the pair of jaws from a first position to at least a second position;

a pair of opposing cutting edges proximate the jaws and configured to cut wire placed between said cutting edges when the handle portions are manipulated to clamp the jaws;

a wedge-shaped pry tool proximate a first end of the first handle portion;

a drive bit receiver proximate a first end of the second handle portion; and an impact surface proximate a second end of one of the first and second handle portions, opposite the respective jaw and cutting edge.

2. The pipe fitting tool of claim 1 wherein the wedge-shaped pry tool is angled in a direction away from the second handle portion.

3. The pipe fitting tool of claim 2 wherein the angle between the pry tool and the first handle portion is between about 10 degrees and about 40 degrees.

4. The pipe fitting tool of claim 1 wherein the impact surface comprises a reinforced portion of the second end and is integrally formed with the respective jaw.

5. The pipe fitting tool of claim 1 further including;

a magnetized member associated with the drive bit receiver to retain a drive bit installed into the drive bit receiver.

6. The pipe fitting tool of claim 1 further including:

a detent in the drive bit receiver configured to engage a corresponding spring biased protrusion associated with a drive bit to be inserted into the drive bit receiver.

7. The pipe fitting tool of claim 1 further comprising:

at least one notch formed into the cutting edges and configured to cut and strip insulation from wire inserted between the cutting edges proximate the notch.

8. The pipe fitting tool of claim 1 further comprising polymeric grips on the first and second handle portions.

9. The pipe fitting tool of claim 8 further comprising:

at least one receptacle formed into the grips for holding a drive bit to be used with the drive bit receiver.

10. The pipe filling tool of claim 9 further including at least one drive bit adapted to be removably received in the drive bit receiver and adapted to be removably held in the at least one receptacle.

11. The pipe fitting tool of claim 8 including first and second receptacles formed into the grips on the first and second handle portions, respectively, each for holding a respective drive bit.

12. The pipe fitting tool of claim 11 further comprising a phillips-type drive bit adapted to be removably held in the first receptacle and a slotted type drive bit adapted to be removably held in the second receptacle, the drive bits further adapted to be removably received in the drive bit receiver.

13. The pipe fitting tool of claim 1, wherein the drive bit receiver is formed into the first end of the second handle portion.

14. A pipe fitting tool comprising:

arc joint adjustable pliers including first and second elongated members with handle portions and jaw portions, the first and second members being pivotally attached between the jaw portions and handle portions through a slot in the second member, the second member having a plurality of arcuate grooves in surrounding relation to the slot and the first member having an arcuately-shaped raised ridge configured to selectively intermesh with each of the arcuate grooves, whereby the relative distance between the jaw portions may be adjusted;

a pair of opposing cutting edges on the first and second members, proximate the jaw portions and configured to cut wire placed between the cutting edges when the handle portions are manipulated to clamp the jaw portions;

a wedge-shaped pry tool proximate the handle portion at a first end of one of the first and second members;

a drive bit receiver proximate the handle portion at a first end of the other of the first and second members; and an impact surface proximate a second end of one of the first and second members, opposite the jaw and cutting edge.

15. The pipe fitting tool of claim 14 wherein the wedge-shaped pry tool at the first end of one of the first and second members is angled in a direction away from the other of the first and second members.

16. The pipe fitting tool of claim 15 wherein the angle between the pry tool and the handle portion is between about 10 degrees and about 40 degrees.

17. The pipe filling tool of claim 14 wherein the impact surface comprises a reinforced portion of the second end and is integrally formed with the respective jaw.

18. The pipe fitting tool of claim 14 further including:

a magnetized member associated with the drive bit receiver to retain a drive bit installed into the bit receiver.

19. The pipe fitting tool of claim 14 further including:

a spring biased protrusion associated with the drive bit receiver and configured to engage a corresponding detent on a drive bit installed into the drive bit receiver.

20. The pipe fitting tool of claim 14 further comprising:

at least one notch formed into the cutting edges and configured to cut and strip insulation from wire inserted between the cutting edges proximate the notch.

21. The pipe fitting tool of claim 14 further comprising polymeric grips on the handle portions of the first and second members.

22. The pipe fitting tool of claim 21 further comprising:

at least one receptacle formed into the grips for holding a drive bit to be used with the drive bit receiver.

23. The pipe fitting tool of claim 22 further including at least one drive bit adapted to be removably received in the drive bit receiver and adapted to be removably held in the at least one receptacle.

24. The pipe fitting tool of claim 21 including first and second receptacles formed into the grips on the handle portions of the first and second members, respectively, each for holding a respective drive bit.

25. The pipe fitting tool of claim 24 further comprising a phillips-type drive bit adapted to be removably held in the first receptacle and a slotted type drive bit adapted to be removably held in the second receptacle, the drive bits further adapted to be removably received in the drive bit receiver.

26. A pipe fitting tool comprising:

arc joint adjustable pliers including first and second elongated members with handle portions and jaw portions, the first and second members being pivotally attached between the jaw portions and handle portions through a slot in the second member, the second member having a plurality of arcuate grooves in surrounding relation to the slot and the first member having an arcuately-shaped raised ridge configured to selectively intermesh with each of the arcuate grooves, whereby the relative distance between the jaw portions may be adjusted;

a pair of opposing cutting edges on the second ends of the first and second members, proximate the jaw portions and configured to cut wire placed between the cutting edges when the handle portions are manipulated to clamp the jaw portions;

at least one notch formed into the cutting edges and configured to cut and strip insulation from a length of wire inserted between the cutting edges proximate the notch;

a wedge-shaped pry tool proximate the handle portion at a first end of one of the first and second members and angled in a direction away from the other of the first and second members;

a drive bit receiver proximate the handle portion at a first end of the other of the first and second members;

a magnetized member associated with the drive bit receiver adapted to retain a drive bit installed into the drive bit receiver; and an impact surface proximate a second end of one of the first and second members, opposite the jaw and cutting edge.

27. The pipe fitting tool of claim 26 further comprising polymeric grips on the handle portions of the first and second members.

28. The pipe filling tool of claim 26 further comprising:

at least one receptacle formed into the grips for holding a drive bit to be used with the drive bit receiver.

29. The pipe fitting tool of claim 28 further including at least one drive bit adapted to be removably received in the drive bit receiver and adapted to be removably held in the at least one receptacle.

30. The pipe fitting tool of claim 28 including first and second receptacles formed into the grips on the handle portions of the first and second members, respectively, each for holding a respective drive bit.

31. The pipe fitting tool of claim 30 further comprising a phillips-type drive bit adapted to be removably held in the first receptacle and a slotted-type drive bit adapted to be removably held in the second receptacle, the drive bits further adapted to be removably received in the drive bit receiver.

* * * * *

UNITED STATES PATENT AND TRADEMARK OFFICE

CERTIFICATE OF CORRECTION

PATENT NO. : 6,725,486 B2
DATED : April 27, 2004
INVENTOR(S) : Thomas J. Oka

It is certified that error appears in the above-identified patent and that said Letters Patent is hereby corrected as shown below:

Column 5,
Line 30, “filling” should be -- fitting --.

Column 6,
Line 8, “filling” should be -- fitting --.

Column 7,
Line 10, “filling” should be -- fitting --.

Signed and Sealed this

Twentieth Day of July, 2004

JON W. DUDAS
*Acting Director of the United States Patent and Trademark Office*